United States Patent [19]

Boyle

[11] 4,249,714

[45] Feb. 10, 1981

[54] ROLLER SHADE BRACKET FOR REVERSIBLE SHADES

[76] Inventor: Carol J. Boyle, 1534 Avocado Ave., Melbourne, Fla. 32935

[21] Appl. No.: 52,245

[22] Filed: Jun. 26, 1979

[51] Int. Cl.[3] ..... A47H 1/10

[52] U.S. Cl. ..... 248/267; 248/254

[58] Field of Search ..... 248/251, 266, 267, 268, 248/269, 270, 271, 272, 252, 254, 255, 256, 257

[56] References Cited

U.S. PATENT DOCUMENTS

| | | | |
|---|---|---|---|
| 373,674 | 11/1887 | McGuire | 248/267 |
| 729,881 | 6/1903 | Mathis | 248/268 |
| 750,848 | 2/1904 | Guiles | 248/267 |
| 759,462 | 5/1904 | Morris | 248/267 |
| 1,851,332 | 3/1932 | Schwarz | 248/267 |
| 2,030,960 | 2/1936 | Burns | 248/267 X |

*Primary Examiner*—J. Franklin Foss
*Attorney, Agent, or Firm*—Harold Gell

[57] ABSTRACT

A roller shade bracket incorporates a slot for receiving a roller shade spring bar and a pivoted adapter secured to the bracket and dimensioned so that it may be rotated over an adapter receiving portion of the bracket to convert the bracket from a spring bar receiving member to a support pin receiving member.

5 Claims, 5 Drawing Figures

FIG 1.
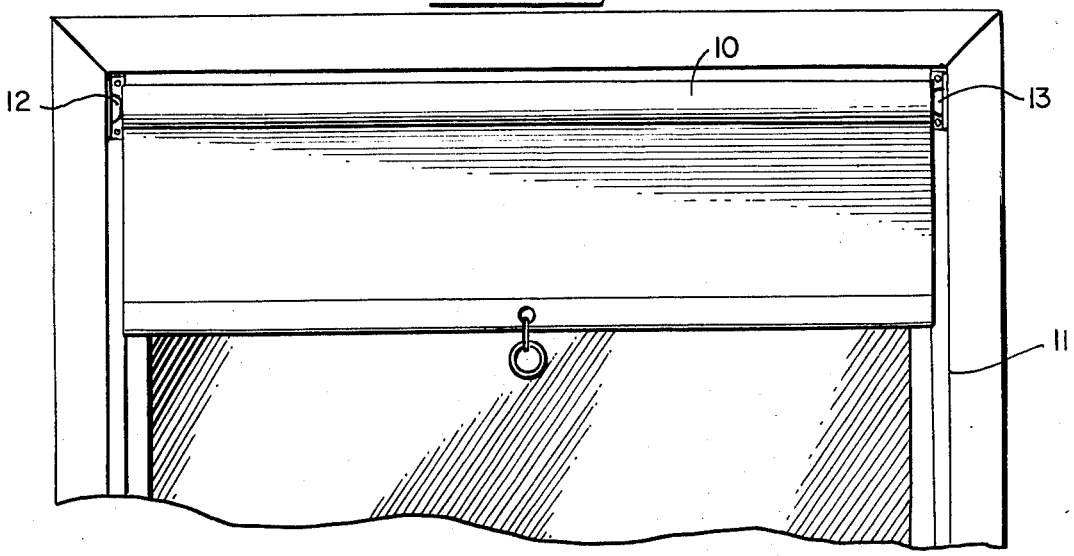
FIG 2.
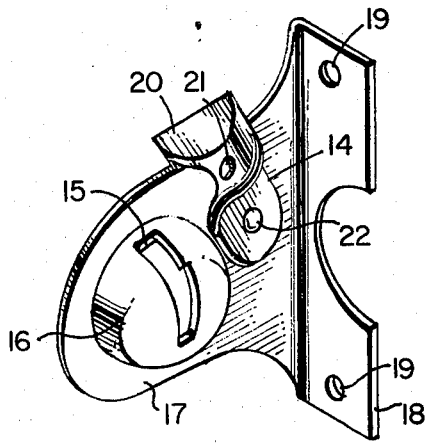
FIG 3.
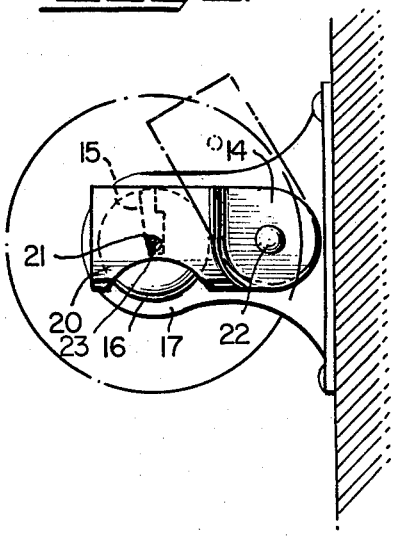
FIG 5.
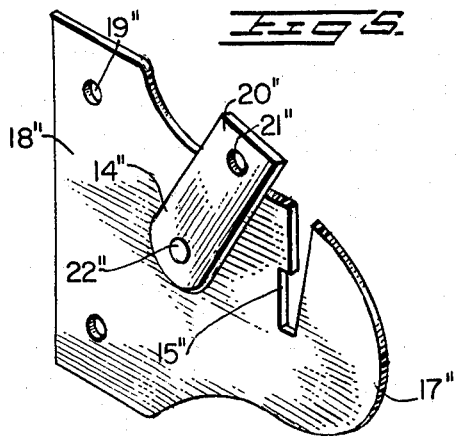
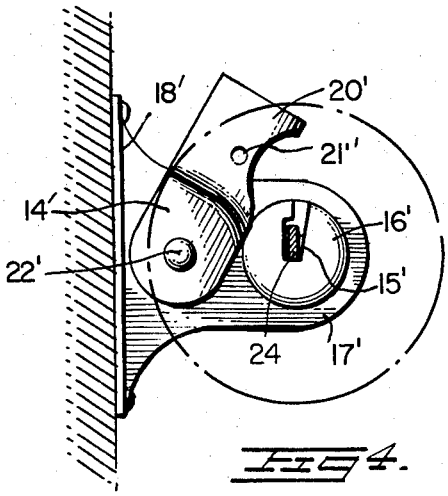
FIG 4.

ROLLER SHADE BRACKET FOR REVERSIBLE SHADES

BACKGROUND OF THE INVENTION

Modern technology has created a heavy drain on natural resources but it has also attempted to conserve those resources be providing more efficient ways to meet the needs of society. One such conservation advancement is the use of reversible window shades which have a thermally absorbing side and a thermally reflective side. Shades such as these are employed in dwelling windows with the thermally reflective side facing out in the summer to prevent solar radiation from entering the dwelling through the window and increasing the load on the air conditioning system. In the cooler months the shade may be reversed and the radiation absorptive side positioned next to the window so that thermal heat from solar radiation may be absorbed and reradiated into the room.

Reversible window shades such as those described above are energy saving devices, however when installed in the average dwelling their full benefit is usually not realized because of the difficulty in reversing the shades. In order to reverse the shade, the brackets must be removed and placed on opposite sides of the window to accommodate reversing the orientation of the roller shade spring bar and support pin. This task prevents the average homeowner from reversing the shades or if the shades are reversed, after a few seasons the window frame suffers severe deterioration due to the constant removal and replacement of shade brackets.

OBJECTIVES OF THE INVENTION

In view of the obvious shortcomings of roller shade brackets to meet the needs of advanced technology reversible shades, it is a primary objective of the present invention to provide a roller shade bracket that will accommodate either the spring bar support end of a roller shade or the support pin end of a roller shade.

A further objective of the present invention is to provide a convertible roller shade bracket which includes a pivoted adapter that may be rotated over the spring bar slot and provide a bore in the general area of the spring bar slot to receive a roller shade support pin.

A still further objective of the invention is to provide a reversible roller shade bracket that is inexpensive to manufacture and provide a durable means to support reversible roller shades.

The foregoing and other objectives of the invention will become apparent in light of the drawings, specification and claims contained herein.

SUMMARY OF THE INVENTION

Presented hereby is a roller shade bracket adapted to be secured to a window frame and provide support for either end of a roller shade. The bracket includes an arm which contains a dome that has a slot formed in the center that is dimensioned to receive and hold the spring bar end of a roller shade. An adapter is secured to the arm by a single pivot point means such as a rivet so that it may be rotated between a first and second position. The free end of the adapter is dimensioned to fit over the dome on the arm and cover the slot formed therein. The free end of the adapter has a small bore which is in alignment with the slot when the adapter arm is rotated in the down position. The small bore is dimensioned to receive the support pin of the roller shade bracket. Thus, the roller shade bracket may be used to support the shade by receiving the spring bar or the support pin, as a function of whether the adapter is rotated in the first or second position.

DESCRIPTION OF THE DRAWINGS

FIG. 1 is a view of a preferred embodiment of the present invention supporting a reversible roller shade.

FIG. 2 illustrates the reversible roller shade bracket with the adapter clip in the open position.

FIG. 3 illustrates the present invention wherein the roller shade clip adapter is in the closed position with the open position shown in phantom line.

FIG. 4 is a side view of the reversible roller shade bracket with the adapter clip in the open position permitting the bracket to support a roller shade via the spring bar.

FIG. 5 illustrates an alternate embodiment of the present invention wherein the bracket includes a straight attachment member.

DESCRIPTION OF THE INVENTION

FIG. 1 depicts a typical installation of a reversible roller shade 10. The shade is supported within the window frame 11 by reversible brackets 12 and 13 so that a preferred side of the shade faces into the room. When it is desired to reverse the shade, it is removed from the brackets 12 and 13 and they are adjusted to receive the opposite ends of the shade so that the shade can be reversed and reinstalled within the window frame.

FIG. 2 illustrates the bracket with the adapter arm 14 in the raised position so that the bracket will accept the spring bar end of the roller shade in the slot 15 formed in the dome 16 of support arm 17. Note that the dome 16 and slot 15 cooperate to form a receptor for the spring bar wherein the spring bar may be dropped through the upper portion of slot 15 which is in the upper portion of dome 16 and rest in the lower portion of slot 15 which is terminated in a section of dome 16 which is a plane perpendicular to the plane of the upper section. In a preferred embodiment, support arm 17 is a 90° projection from a flange 18 which has a plurality of bores 19 through which the bracket may be secured to a window frame by screws or nails.

In FIG. 3, the bracket is illustrated with the adapter arm 14 in the closed position. The end of the adapter arm 20 is formed so that it will fit over the dome 16 of the support arm 17. The end 20 of adapter arm 14 includes a bore 21 which, when the adapter arm is down as illustrated in FIG. 3, is in alignment with the slot 15 which receives the spring bar of the roller shade. However, with the adapter arm 14 in the lowered position as illustrated in FIG. 3, the spring bar of the roller shade will not fit in the bracket but the support pin 23 will be received through slot 15 by the bore 21 which serves as a bearing for pin 23. Thus the bracket may be used to receive either the support pin 23 or as illustrated in FIG. 4, the spring bar 24 as a function of the position of adapter arm 14 or 14'.

FIG. 4 illustrates the adapter arm 14' in the raised position which will permit slot 15' to receive the spring bar 24 of a roller shade. Thus two identical brackets, one configured as illustrated in FIG. 3 and the other with the adapter arm configured as illustrated in FIG. 4 may be used to support a roller shade. For instance, if the shade 10 of FIG. 1 has spring bar 24 at the left side of the shade, bracket 12 would be configured similar to the bracket illustrated in FIG. 4, that is, adapter arm 14' is in the raised position. The other end of the shade would have the support pin 23 and therefore bracket 13 of FIG. 1 would be configured similar to the bracket as illustrated in FIG. 3. In FIG. 3 the adapter arm 14 is in the lowered position and the bore 21 in the adapter arm is centered in the bracket to receive the support pin 23.

Adapter arm 14 is raised or lowered by rotating it about rivet 22 which secures the adapter to the bracket arm. Rivet 22 passes through both the adapter and the support arm and binds the two together while permitting the adapter to be rotated over or off of the dome 16. The dome 16 and end 20 of adapter 14 are dimensioned so that a tight mechanical fit exists which has a tendency to bind the adapter in the lowered position when placed therein. In a preferred embodiment, the rivet 22 holds the arm and adapter firmly together so that when the support arm 14 is raised, the binding friction created by the tension of the rivet between the adapter 14 and arm 17 prevents the arm from freely rotating under the force of the gravity but does not create resistance great enough to prevent a person from manipulating the adpater with their bare hands.

In a preferred embodiment, the reversible roller shade bracket illustrated in FIGS. 2, 3 and 4 is manufactured from two metal stampings, one comprising the adapter 14 and the other comprising the arm 17 and flange 18. In this embodiment, after the stampings have been fabricated the flange is bent and the adapter riveted to the arm or the adapter is first riveted to the arm and then the flange is bent as a function of the most expedient tooling processes. In an alternate embodiment illustrated in FIG. 5, flange 18'' is not bent 90° to arm 17'' and the bracket is held to the window frame by securing the bracket to the frame through the bores 19'' and nails or screws which are caused to enter the sides of the window frame.

A further adaptation of the present invention is illustrated in the alternate embodiment shown in FIG. 5 wherein the support arm 17'' does not include a domed section. In this embodiment the spring bar slot 15'' is formed in the flat surface of support arm 17'' and the adapter bracket 14'' is a flat metal bar secured to support arm 17'' by a rivet 22'' so that it will function in a manner similar to that described for the previous embodiments except there is no convexed section to cooperate with a domed portion on the support arm.

A still further embodiment of the invention is contemplated wherein the brackets are fabricated from a material other than metal, such as one of the many commercially available plastics which have the necessary rigidity.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A roller shade support bracket, comprising:

a support arm;

a slot formed in said support arm and dimensioned to receive a roller shade spring bar and support said roller shade spring bar in a position where the axial center of said bar is in the longitudinal center of said support arm, said slot including a flat bottom, a first side forming an angle with said flat bottom of greater than 90° and a second side forming an angle of 90° with said bottom, said second side including a bottom segment dimensioned to receive said roller shade spring bar and an upper segment projecting toward but not touching said first side for locking said roller shade spring bar in said slot;

an oblong adapter arm;

a bore formed in said adapter arm at one end and in the longitudinal center thereof dimensioned to receive a roller shade support pin and function as a bearing surface for said roller shade support pin; and means located at the end of said oblong adapter arm opposite said bore containing end for connecting said adapter arm to said support arm so that said adapter arm may be rotated about said means for connecting between a first position wherein said slot and said bore are in alignment at the longitudinal center of said support arm and a second position wherein said adapter arm will not interfere with said roller shade spring bar.

2. A roller shade support bracket as defined in claim 1, further comprising:

a dome shaped protrusion formed in said support arm and positioned so that said slot is in the upper portion of said dome with one portion of said slot lying in a plane perpendicular to the plane in which the other end of said slot is positioned on the surface of said dome; and a concaved section formed in said adapter arm positioned so that said adapter arm may be rotated over said dome and said bore may be aligned with the portion of said slot which is in a plane parallel to the plane of said support arm.

3. A roller shade support bracket as defined in claim 2 wherein said means for connecting is a rivet.

4. A roller shade support bracket as defined in claim 3 wherein the end of said support arm opposite the end containing said slot contains a member perpendicular to the plane of said support arm and said perpendicular member includes a plurality of bores.

5. A roller shade support bracket as defined in claim 3 wherein said rivet is peened to an extent to create a binding forced between said support arm and said adapter arm, said binding force within a range which will prevent gravitational forces from moving said adapter arm but which will permit movement of said adapter arm by an operator without the aid of tools.

* * * * *